US005682868A

United States Patent [19]

Moraal

[11] Patent Number: 5,682,868

[45] Date of Patent: Nov. 4, 1997

[54] ENGINE CONTROLLER WITH ADAPTIVE TRANSIENT AIR/FUEL CONTROL USING A SWITCHING TYPE OXYGEN SENSOR

[75] Inventor: Paul Eduard Moraal, Ann Arbor, Mich.

[73] Assignee: Ford Global Technologies, Inc., Dearborn, Mich.

[21] Appl. No.: 523,489

[22] Filed: Sep. 5, 1995

[51] Int. Cl.[6] ..... F02D 41/14; F02D 41/10; F02D 41/12

[52] U.S. Cl. ..... 123/682

[58] Field of Search ..... 123/480, 492, 123/493, 682, 693, 694; 364/431.05

[56] References Cited

U.S. PATENT DOCUMENTS

| | | | |
|---|---|---|---|
| 4,377,143 | 3/1983 | Hamburg | 123/672 |
| 4,905,653 | 3/1990 | Manaka et al. | 123/674 |
| 4,922,429 | 5/1990 | Nakajima et al. | 364/431.06 |
| 4,932,376 | 6/1990 | Linder et al. | 123/422 |
| 5,181,496 | 1/1993 | Kojima | 123/493 |
| 5,325,711 | 7/1994 | Hamburg | 73/118.1 |
| 5,524,599 | 6/1996 | Kong et al. | 123/682 |
| 5,553,593 | 9/1996 | Schnaibel et al. | 123/682 |

*Primary Examiner*—Tony M. Argenbright
*Attorney, Agent, or Firm*—Allan J. Lippa

[57] ABSTRACT

An Electronic Engine Controller (EEC) which controls operation of an engine employs a switching type oxygen sensor to determine the composition of exhaust gas produced by the engine. The EEC enhances the signal received from the oxygen sensor to generate quantitative information from the qualitative information received from the oxygen sensor. The EEC utilizes the enhanced information from the oxygen sensor to adapt Transient Fuel Control (TFC) parameters. The EEC detects a transient, quantifies the transient in terms of two TFC parameters and adapts the TFC parameter employing fuzzy-logic controls.

12 Claims, 7 Drawing Sheets

400
Enter
308
402
Read dC and RV
404
abs (dC) > 1.5 RV
?
No
Yes
406
Adjust RV:
RV: = 2/3 abs (dC)
408
Scale dC by RV
410
Return 500
Enter
322
324
502
Determine dC and △ A/F
504
Determine correction factor CF
506
dC and △A/F have the same sign ?
No
508
Multiply TFC parameters by (2 - CF)
Yes
510
Multiply TFC parameters by CF
512
Return 1.1
1.05
1
.95
.9

1.2
1.1
1
.9
.8
signals 1.04
1.02
1

1.04
1.02
1
.98
.96
0
1
2
3
4
5
Time (seconds)
Possible modulation signals

ENGINE CONTROLLER WITH ADAPTIVE TRANSIENT AIR/FUEL CONTROL USING A SWITCHING TYPE OXYGEN SENSOR

FIELD OF THE INVENTION

This invention relates generally to the field of engine controls and more particularly to controlling the delivery of fuel during transient engine operation.

BACKGROUND OF THE INVENTION

Engines which utilize fuel injectors positioned in the induction system of the engine experience "wall wetting" effects, which occur when a portion of the fuel injected by a fuel injector into the induction system remains in the induction system. The amount of fuel in the induction system, herein referred to as the "fuel film mass", remains essentially constant during steady state operation, but varies during transient engine operation. If not compensated, or if improperly compensated for, by the engine fuel control system, these fuel dynamics cause temporary air/fuel excursions during transient operation of the engine. Compensation for the fuel film mass during transient operation is typically performed by utilizing a dynamics compensator with a set of predetermined values which are stored as a function of engine temperature and other engine operating conditions.

In order to adapt to changing conditions, such as aging of components and build-up of intake valve deposits, and to initial miscalibrations, certain fuel control systems incorporate adaptation mechanisms which detect the concentration of oxygen in exhaust gas generated by the engine and alter the characteristics of the dynamic compensator. Unfortunately, most adaptation schemes propose the use of a linear exhaust gas sensor, which provides quantitative information, for detecting the concentration of exhaust gas. In contrast, existing vehicles often utilize a switching type of exhaust gas oxygen sensor which provides a binary indication of the exhaust gas composition. Such sensors provide a first voltage level of the exhaust gas composition is rich of stoichiometry and provide a second voltage level if the exhaust gas composition is lean of stoichiometry. Thus many existing schemes which rely on the presence of quantitative information cannot be used with the low-cost switching type of sensors used on many vehicles. Moreover, known fuel control schemes provide adaptation of fuel control parameters only during steady state conditions or, fail to take into account the necessary variables when adapting for transient conditions.

It is accordingly an object of the present invention to provide an engine controller which improves engine operation during transient conditions by adapting fuel delivery to an intake of the engine in response to information received from a switching type oxygen sensor.

SUMMARY OF THE INVENTION

In a first aspect of the invention, an electronic engine controller (EEC) receives an oxygen sensor signal from a switching type oxygen sensor which generates a first indication if exhaust gas produced by the engine is rich of stoichiometry and a second indication if exhaust gas produced by the engine is lean of stoichiometry. The EEC generates an enhanced air/fuel value indicative of the air/fuel ratio combusted by the engine as a function of the oxygen sensor signal. A means, which is responsive to the enhanced air/fuel value, generates a fuel injection value which is indicative of an amount of fuel injected by a fuel injector into an induction system of the engine. The fuel injection value is generated by determining the magnitude of a transient engine operating condition and responding to the magnitude by characterizing the transient in terms of one of a plurality of predefined transient characterization groups, to adapt an equilibrium fuel time constant, representative of a rate of change of the fuel mass on the walls of the induction system during the transient engine operating condition, and to adapt a fuel transfer rate value which is indicative of the portion of fuel injected from said injector which remains on the walls of said induction system.

An advantage of certain preferred embodiments is that cost is reduced and engine operation is enhanced by adapting transient engine operating parameters in response to information generated by a switching type oxygen sensor. The switching type oxygen sensor provides high reliability at low cost and the adaptation reduces calibration requirements by adapting transient fuel parameters as specifically required by the engine, to enhance engine operation and reduce unwanted emissions.

These and other features and advantages of the present invention may be better understood by considering the following derailed description of a preferred embodiment of the invention. In the course of this description, reference will frequently be made to the attached drawings.

DETAILED DESCRIPTION

System Overview

Figure 1:
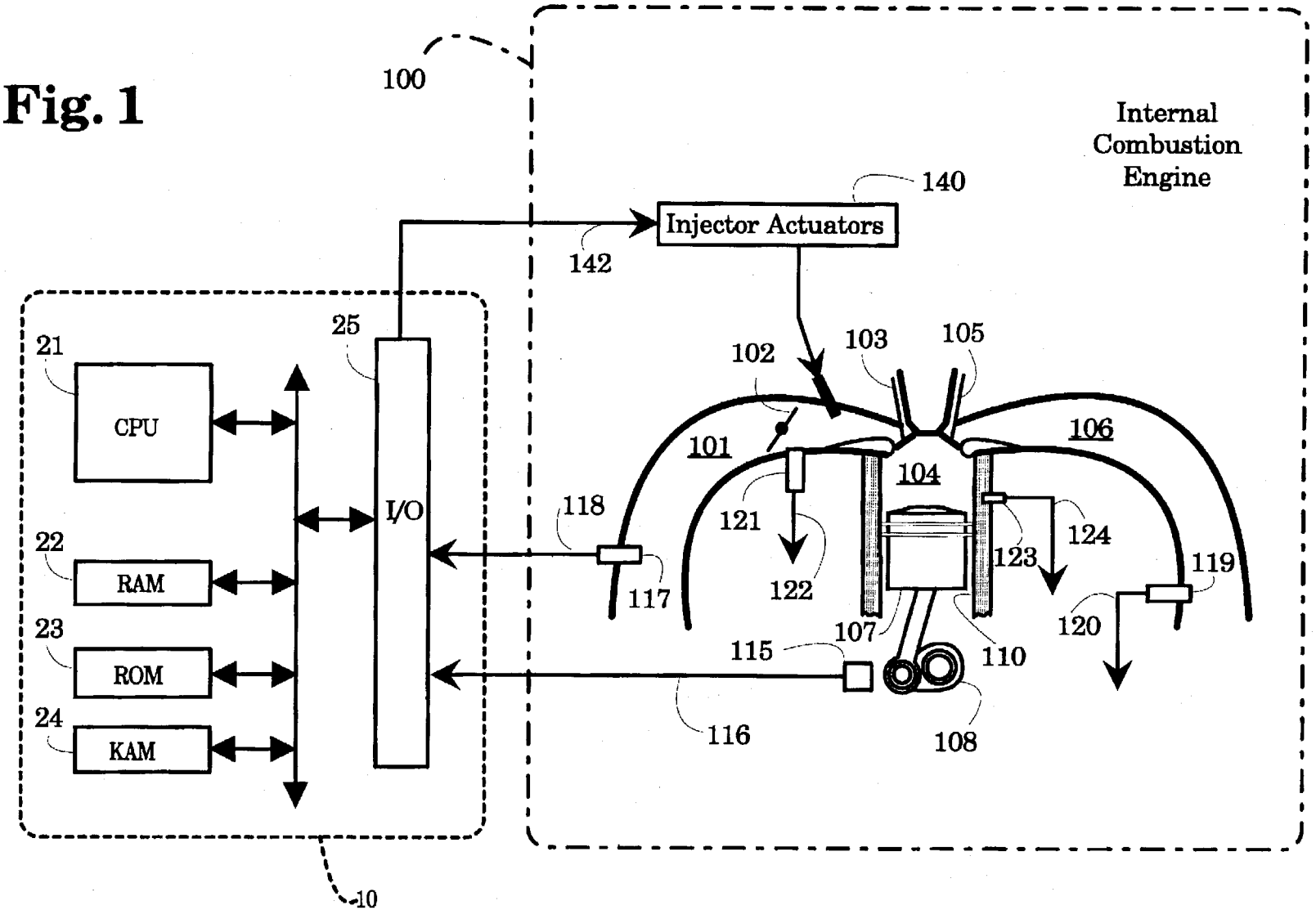
FIG. 1 of the drawings is a schematic illustration of an engine and engine controller which utilize the principles of the invention.

FIG. 1 of the drawings shows an Electronic Engine Controller (EEC) 10 and an internal combustion engine 100. Engine 100 draws an aircharge through an intake manifold 101, past a throttle plate 102, an intake valve 103 and into combustion chamber 104. An air/fuel mixture which consists of the aircharge and fuel, is ignited in combustion chamber 104, and exhaust gas produced from combustion of the air/fuel mixture is transported past exhaust valve 105 through exhaust manifold 106. A piston 107 is coupled to a crankshaft 108, and moves in a reciprocating fashion within a cylinder defined by cylinder walls 110.

A crankshaft position sensor 115 detects the rotation of crankshaft 108 and transmits a crankshaft position signal 116 to EEC 10. Crankshaft position signal 116 preferably takes the form of a series of pulses, each pulse being caused by the rotation of a predetermined point on the crankshaft past sensor 115. The frequency of pulses on the crankshaft position signal 116 are thus indicative of the rotational speed of the engine crankshaft. A Mass AirFlow (MAF) sensor 117 detects the mass flow rate of air into intake manifold 101 and transmits a representative air meter signal 118 to EEC 10. MAF sensor 117 preferably takes the form of a hot wire air meter. A Heated Exhaust Gas Oxygen (HEGO) sensor 119 detects the concentration of oxygen in exhaust gas produced by the engine and transmits an exhaust gas composition signal 120 to EEC 10 which is indicative of the composition of the exhaust gas. HEGO sensor 119 preferably takes the form of a switching type of sensor which produces a low voltage signal (approximately 0.1 volts) when the exhaust gas it is exposed to contains oxygen levels in excess of stoichiometry, and a high voltage signal (approximately 0.9 volts) otherwise. A throttle position sensor 121 detects the angular position of throttle plate 102 and transmits a representative signal 122 to EEC 10. Throttle position sensor 121 preferably takes the form of a rotary potentiometer. An engine coolant temperature sensor 123 detects the temperature of engine coolant circulating within the engine and transmits an engine coolant temperature signal 124 to EEC 10. Engine coolant temperature sensor 123 preferably takes the form of a thermocouple.

Injector actuators 140 operate in response to fuel injector signal 142 to deliver an amount of fuel determined by fuel injector signal 142 to combustion chambers 104 of the engine. EEC 10 includes a central processing unit (CPU) 21 for executing stored control programs, a random-access memory (RAM) 22 for temporary data storage, a read-only memory (ROM) 23 for storing the control programs, a keep-alive-memory (KAM) 24 for storing learned values, a conventional data bus, and I/O ports 25 for transmitting and receiving signals to and from the engine 100 and other systems in the vehicle.

A preferred embodiment of EEC 10 advantageously processes the exhaust gas composition signal 120 from the HEGO sensor 119 to enhance the information content of the signal to obtain a quantitative evaluation of the exhaust gas composition from a sensor which provides only qualitative information. In a preferred embodiment, the resulting air/fuel value is used by an adaptive mechanism which alters transient fuel response characteristics of the engine controller.

Oxygen Signal Enhancement

Figure 2:
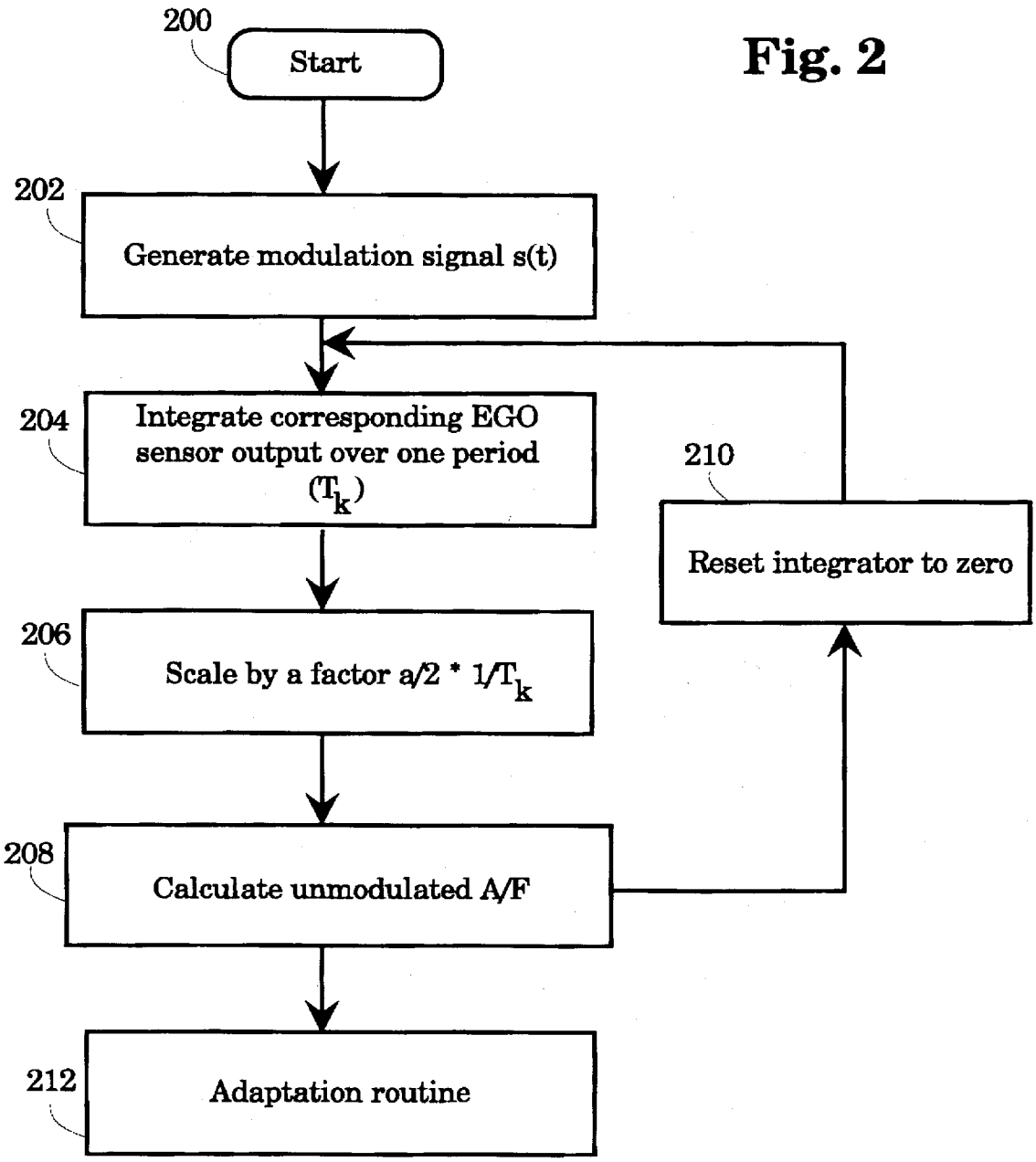
FIGS. 2, 3, 4 and 5 are flowcharts illustrating the operation of a preferred embodiment.
Figure 3:
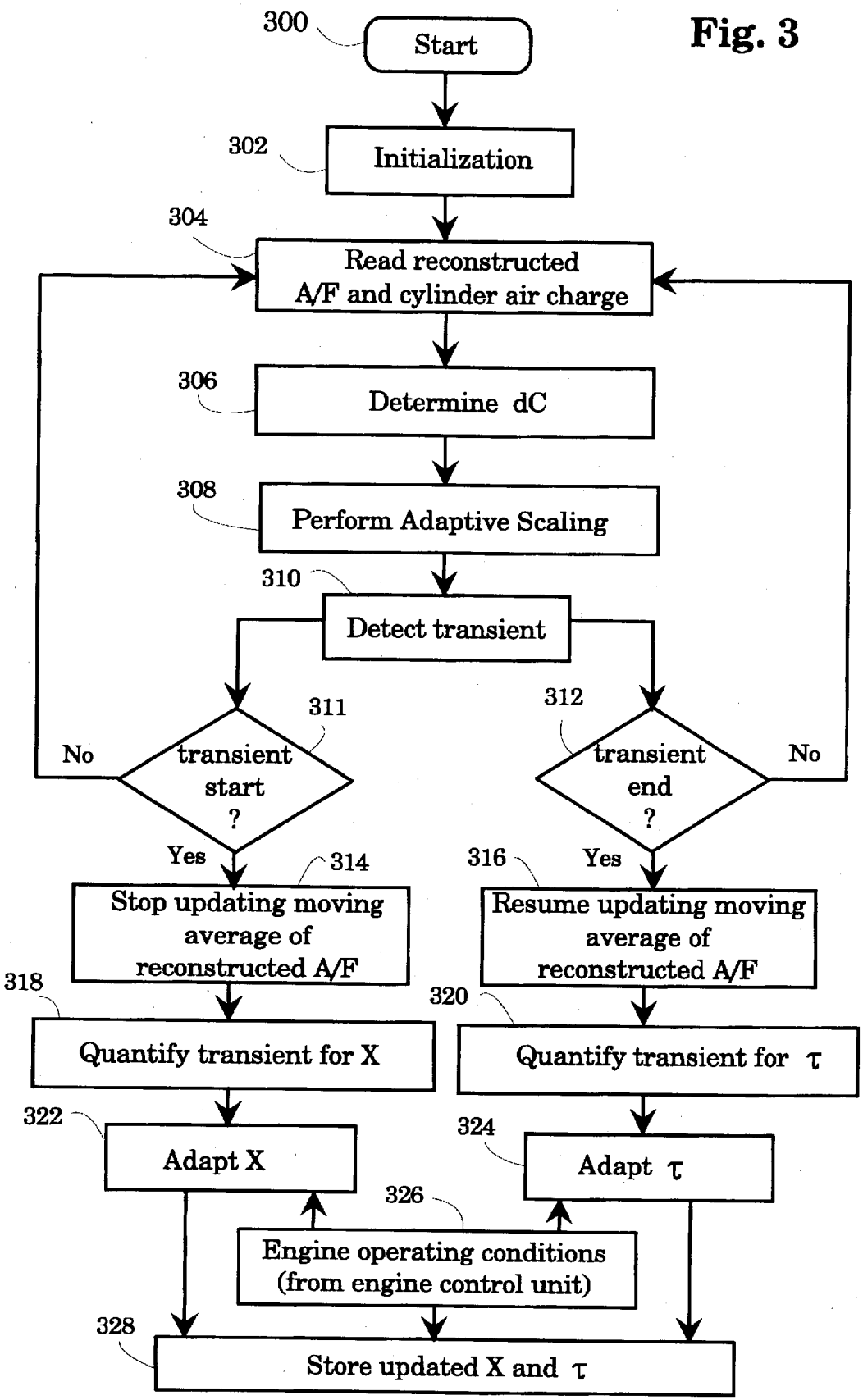

FIGS. 2 and 3 are flowcharts showing the steps executed by a preferred embodiment to implement, respectively, an oxygen signal enhancement routine and a transient fuel control adaptation routine. The steps shown in FIGS. 2 and 3 are preferably implemented as programs stored in ROM 23 and executed by CPU 21 as a part of an interrupt driven routine during all phases of engine operation.

In FIG. 2 the oxygen signal enhancement routine is entered at step 200, and at step 202, a fuel modulation signal is generated to modulate the fuel injector signal 142. Preferably the modulation signal modulates the fuel injector pulse width. Alternatively, if the engine is operating in closed-loop control, the existing A/F feedback signal used in closed-loop control is interpreted as a modulation signal and may be used with no additional modulation being imposed on the fuel injector signal. As used herein, the term modulation signal is understood to describe both the instance where modulation of the fuel injector signal is imposed and the instance where the A/F feedback signal is used with no additional modulation imposed upon it.

Figure 6:
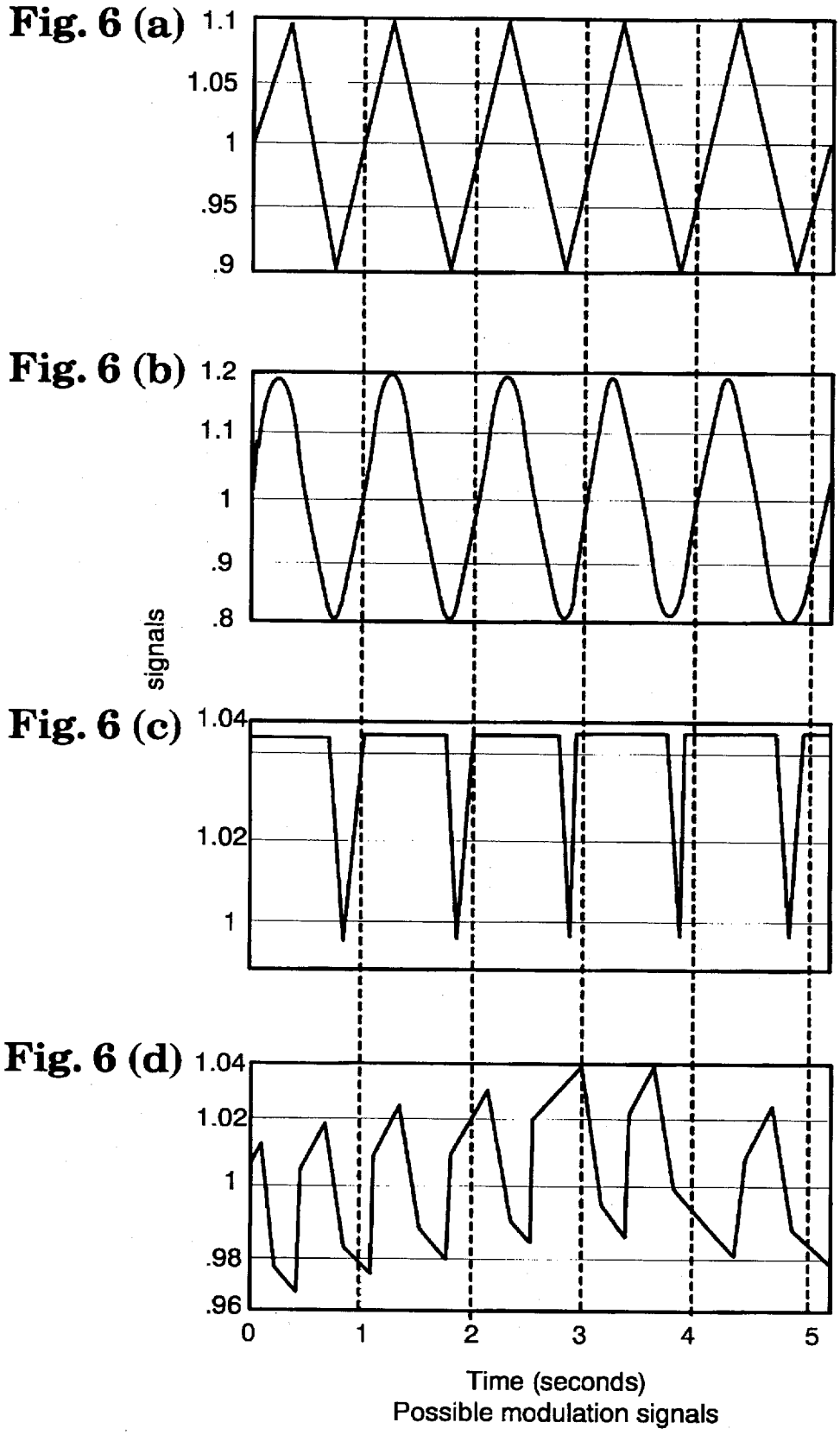
FIGS. 6(*a*), 6(*b*), 6(*c*), 6(*d*) and 7 are graphical illustrations of the operation of a portion of a preferred embodiment.

The frequency of the modulation signal may vary. In addition, the shape of the modulation need not be symmetric around one. Four different modulation signals which may be used are shown in FIGS. 6(*a–d*). In FIGS. 6(*a–d*) the horizontal axis represents time in seconds, and the vertical axis represents the value of the multiplicative fuel modulation signal. In FIG. 6(*a*), the fuel modulation signal takes the form of a periodically occurring sawtooth shaped signal which oscillates by a magnitude of approximately ten percent (10%) about a unity value. In FIG. 6(*b*), the fuel modulation signal takes the form of a periodically occurring sinusoidal signal which oscillates by a magnitude of approximately twenty percent (20%) about a unity value. In FIG. 6(*c*), the modulation signal, rather than oscillating about a unity value, is periodically ramped up to and maintained at a value approximately five percent (5%) above unity and then ramped down to unity at the same rate at which it was ramped up, and the cycle is then repeated. In FIG. 6(*d*), the modulation signal exhibits a time-varying frequency and amplitude. Moreover, its average value over each period is time-varying. As can be seen, the modulation frequency ($f_k$) varies, but typically is in the range of 0.5 Hz–2 Hz.

Once a modulation signal is generated and applied, the routine enters a loop comprising steps 204, 206, 208 and 210, where a "jumping window average" of the exhaust gas composition signal 120 is generated at steps 204 and 206, and an enhanced A/F value is generated at step 208. The jumping window average is generated by integrating the received exhaust gas composition signal 120 at step 204 over one modulation period, which is the inverse of the modulation frequency. At step 206, the integrated value generated at step 204 is scaled by a factor of $\{1/T_k * a/2\}$ which is the product of the length of the integration interval and the amplitude of the superimposed A/F modulation, thus providing a value which is indicative of the average A/F excursion from stoichiometry over the integration period. In addition, if the modulation signal is not centered around one, i.e., the integral of this signal over one period is not equal to one, then the integrated value is scaled by the reciprocal of the signal's average value K. At step 208 the enhanced A/F value is generated in accordance with the following relationship:

$$A/F_k = \frac{\int_{t_{k-1}}^{t_k} EGO\,dt * \frac{1}{T_k} * \frac{a}{2} + 1) * 14.64}{K} \tag{1}$$

where, $A/F_k$ is the enhanced A/F value;

EGO is the exhaust gas composition signal 120 scaled such that a value of +1 indicates lean and a value of −1 indicates rich;

$T_k$ is the period of the modulation signal;

$t_{k-1}$ and $t_k$ are integration limits where $T_0=0$ and $t_k=t_{k-1}+T_k$ $\alpha$ is the peak-to-peak amplitude of the modulation signal; and K is the average value of the modulation signal over one integration interval.

In order to account for the transport delay, i.e., the amount of time it takes the exhaust gas to travel from the cylinder 110 to the location of the HEGO sensor 119, the scaling factor K may also be determined by the following relationship:

$$K = \frac{1}{T_k} \int_{t_{k-1}}^{t_k} s(t - T_d)dt \tag{2}$$

where, $T_k$ is the period of the fuel modulation signal;

s(t) is the fuel modulation signal; and $T_d$ is a quantity indicative of the transport delay.

The value generated at step 208 differs from a conventional moving average calculation because of the resetting of the integrator at step 210 to zero at the start of each integration interval. The intervals do not overlap. Instead the enhanced A/F value generated at step 208 represents one integration period, and hence may be more accurately referred to as a jumping window average. The enhanced A/F value represents the A/F signal corresponding to open-loop fuel control. The loop comprising steps 204, 206, 208 and 210 is preferably executed continuously. The period $T_k$ over which the EGO and modulation signals are averaged may also be chosen as a constant independent of the period of the modulated signal.

Adaptive Modification of TFC Parameters

The enhanced A/F value generated at step 210 may be used for a variety of purposes by the engine controller. In a preferred embodiment, the enhanced A/F value is utilized by the engine controller to adaptively modify transient fuel control (TFC) variables which compensate for wall wetting effects during transient engine operation. A transient fuel control strategy which compensates for wall wetting effects, particularly during engine warm-up, is described in U.S. Pat. No. 5,353,768 entitled *Fuel Control System with Compensation for Intake Valve and Engine Coolant Temperature Warm-Up Rates,* which issued on Oct. 11, 1994 and which is assigned to the assignee of the present application.

Fuel film dynamics (also referred to as "wall wetting") can be described by a first order transfer function which takes the following form: where, $$T_{fuel}(s:\tau,X)=\frac{X}{\tau s+1}+(1-X) \tag{3}$$

$T_{fuel}$ is the transfer function from injected to inducted fuel.

$\tau$ is a time constant indicative of the rate of change of fuel mass on the walls of the induction system;

X is the fraction of fuel flow into the fuel film residing on the walls of the intake system; and s is the free variable.

Parameters $\tau$ and X depend upon engine operating conditions, and possibly fuel composition, and may change over time due to aging phenomena such as build up of deposits on the intake valves. In a preferred embodiment, TFC is performed by use of a dynamic compensator which implements the following transfer function:

$$T_{comp}(s:\tau,X)=\frac{1}{T_{fuel}(s:\tau,X)} \tag{4}$$

where, $T_{fuel}(S:\tau,x)$ is as defined above.

A preferred embodiment advantageously utilizes the enhanced A/F value to modify the transient fuel control parameters $\tau$ and X to compensate for the effects of aging, such as caused by intake valve deposits, as well as for variability among engines. As noted above, FIG. 3 of the drawings shows the steps executed by a transient fuel control adaptation routine.

At every sampling time $t_k$, the TFC adapter receives two input signals, namely, averaged air charge $C_k$ and air-fuel ratio $(A/F)_k$. Based on these signals, the TFC adapter decides whether to update the TFC parameters, and, if so, by how much. The adaptation strategy may be summarized as follows:

1. If there is no air charge transient, don't change TFC parameters.

2. If there is no A/F excursion, don't change TFC parameters.

3. If a large air charge transient causes a small A/F excursion, change TFC parameters slightly.

4. If a small air charge transient causes a large A/F excursion, change TFC parameters significantly.

The TFC parameters are advantageously changed by different amounts as necessary. It has been observed that a "miscalibration" of the $\tau$-parameter causes an A/F excursion that may last longer than the actual air charge transient, whereas a miscalibration of the X-parameter affects mostly the initial part of the A/F excursion. The preferred embodiment to be described advantageously adapts TFC parameter X using information from the first sampling period after a transient is detected, and adapts TFC parameter $\tau$ using the A/F excursion during the last sampling period of the air flow transient. For short transients, these two sampling periods may coincide.

The steps summarized above are described in greater detail below and may be grouped into three major functional groups: Transient Detection, Transient Quantification, and Parameter Adaptation.

Initialization and Transient Detection

The transient fuel control adaptation routine is initiated at step 300, and at step 302 the moving average of the reconstructed air/fuel and correction factors for X and $\tau$ are each initialized to a value of one the first time the engine is started. Afterward, when the engine is started, the correction factors are retrieved from KAM 24 to allow for long term learning of the factors. Steps 304–312 implement a loop to determine if a transient in the engine aircharge has occurred. If a transient in the aircharge is detected to have begun, then adaptation of TFC parameter X is performed at steps 314, 318, 322 and 326. If a transient in the aircharge is detected to have ended, then adaptation of TFC parameter $\tau$ is performed at steps 316, 320, 324 and 326. The updated parameter X and x are stored in the KAM 24 at step 328.

At step 304, the enhanced A/F value is retrieved, and a cylinder air charge value $C_k$ which is indicative of the average cylinder air charge during the period $T_k$ is calculated by averaging the air meter signal 118, or another appropriate EEC signal indicative of the instantaneous cylinder air charge, over a modulation period $T_k$ of the modulation signal.

The average of the air meter signal is then preferably delayed for an mount of time equal to the transport delay of the exhaust gas between the exhaust port and the oxygen sensor location to generate the average air charge value $C_k$. Delaying the average of the air meter signal advantageously synchronizes any transients in air charge with excursions in A/F.

At step 306, the rate of change of cylinder air charge (dC) is determined to detect the presence of transients. Updating of TFC parameters is advantageously performed after transient operation has occurred, rather than continuously. At every sampling time, $t_k$, a discretized normalized rate of change $dC_k$ of cylinder air charge is calculated:

$$dC_k=\frac{2(C_k-C_{k-1})}{(C_k+C_{k-1})T_k} \tag{5}$$

Figure 4:
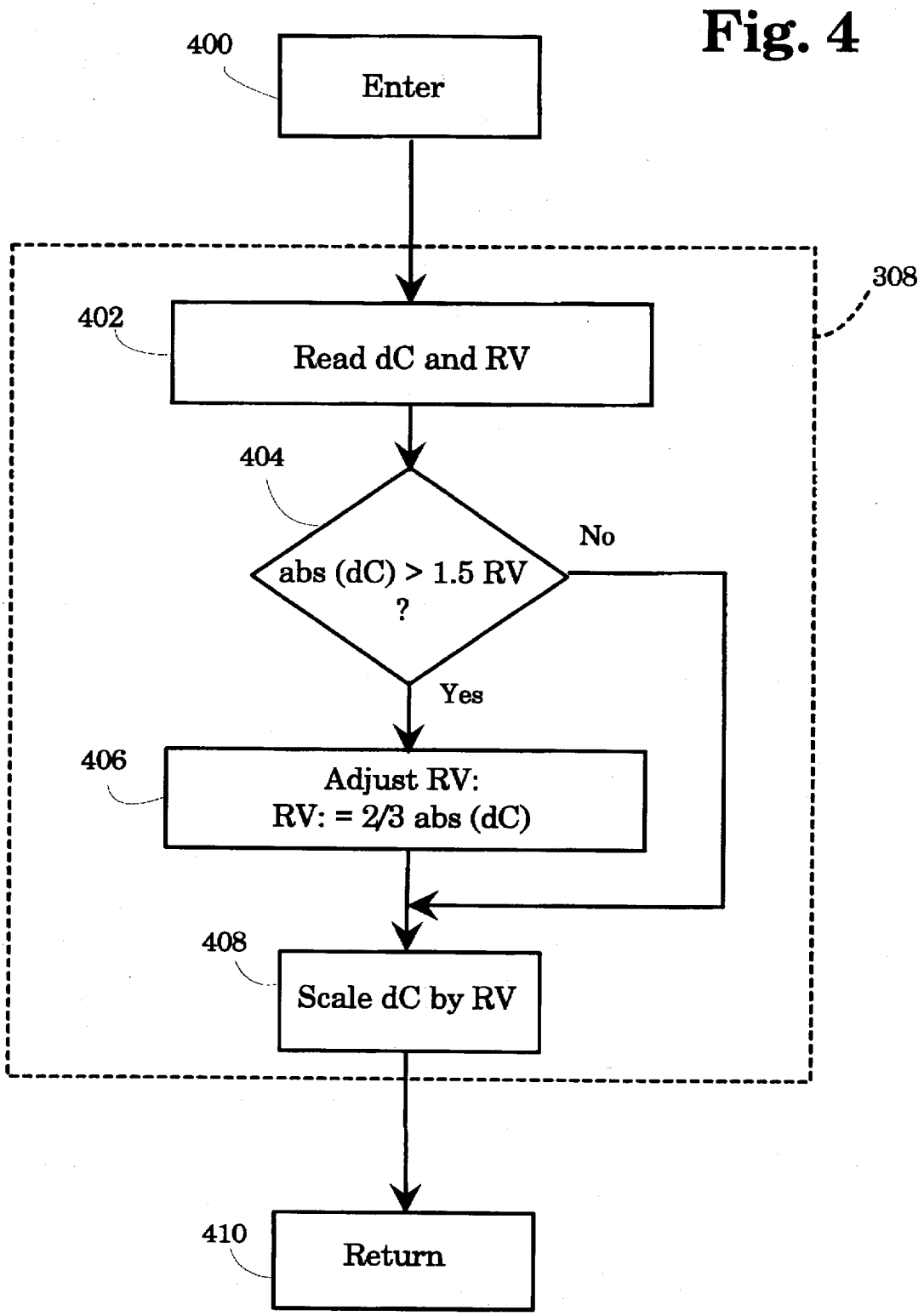

During steady-state air conditions, $dC_k$ will be approximately zero. At step 308 adaptive scaling of a reference value (RV), against which the rate of change of aircharge is compared, is performed. FIG. 4 of the drawings shows the steps performed at step 308 in greater detail. At step 402, the values dC and RV are read from memory and at step 404 the magnitude of dC is compared to a multiple of RV. As seen at 404, the multiple is preferably a value of 1.5. If the rate of change of the aircharge dC is greater than the reference value (RV) times the multiple, then at step 406 the reference value is modified as a function of dC. As seen at step 406, RV is set equal to two-thirds the magnitude of dC. At step 408, the value dC is scaled by the value RV, which may have been modified at step 406, to normalize the rate of change of air charge dC. The reference value may occasionally be reset to reduce the effect of spurious extreme values of dC. Modification of the reference value in the manner shown in FIG. 4 advantageously eliminates the need for calibration to determine a value for RV. Instead, the value of RV may be adaptively modified to ensure proper performance regardless of engine type and size.

At steps 310–312, transient detection of the aircharge is performed. A transient start trigger signal, which triggers X-adaptation (adaptation of the TFC parameter X) is set to a value of one to trigger X-adaptation when the following condition occurs:

$$\text{abs}(dC_k)>\text{threshold and abs}(dC_{k-1})<\text{threshold}, \quad (6)$$

and equals zero otherwise. The variable threshold is a calibratable value which may be set at an appropriate level to avoid small fluctuations in air charge which would otherwise be interpreted as transients. A transient end trigger signal, which triggers τ-adaptation (adaptation of the TFC parameter τ) is set to a value one to enable τ-adaptation when the following condition occurs:

$$\text{abs}(dC_k)\leq\text{threshold and abs}(dC_{k-1})>\text{threshold}, \quad (7)$$

and equals zero otherwise.

Transient Quantification

If the transient start trigger signal is set to a value of one, then at step 314, updating of the moving average $(A/F)_{ref}$ of the reconstructed A/F is halted. Alternatively, if the transient end trigger signal is set to a value of one then at step 316, updating of the moving average $(A/F)_{ref}$ of the reconstructed A/F is resumed. At step 318 and at step 320, the transient for X and τ, respectively, is quantified.

TFC variable X is adapted using the information of the sampling period k in which transient_start(k)=1. As used herein, the transients will be denoted by $A_x$ (air flow transient) and $(\Delta A/F)_x$ (air/fuel transient) and are defined as:

$$A_x=dC_k, \text{ If transient_start(k)=1, zero otherwise.} \quad (8)$$

$$(\Delta A/F)_x=(A/F)_k-(A/F)_{ref,k} \quad (9)$$

where, $(A/F)_{ref,k}$ is the moving average at time $t_k$ of the reconstructed A/F signal $(A/F)_k$. For adaptation of τ, the transients are quantified differently, since the air flow during the entire transient should be preferably captured. The transients used in the τ-adaptation are denoted herein by $A_{96}$ (air flow) and $(\Delta A/F)_\tau$ and are defined as:

$$A_\tau=\left(\sum_{\text{transient_start}}^{\text{transient_end}} dC_{k-1}\right)\Big/\left(\sum_{\text{transient_start}}^{\text{transient_end}} 1\right) \quad (10)$$

$$(\Delta A/F)_\tau=(A/F)_{k-1}-(A/F)_{ref,k-1} \quad (11)$$

if transient_end(k)=1, zero otherwise. Note that the trigger transient_end(k) is set to one after the end of an air flow transient. Therefore, the A/F excursion at the end of the air flow transient is given by $(A/F)_{k-1}$, not by $(A/F)_k$. An alternative definition for $A_\tau$ is:

$$A_\tau=\frac{1}{2}(A_x+dC_{k-1}) \text{ if transient_end}(k)=1\text{, zero otherwise} \quad (12)$$

The value $A_\tau$ advantageously captures the air flow transient over a period related to the duration of the transient, not necessarily just one sampling period.

Parameter Adaptation

After the transient signals have been properly quantified at steps 318 and 320, parameter adaptation is performed at steps 322 and 324. Preferably adaptation of the TFC parameters X and τ is implemented by "fuzzy control," i.e., rule based, fuzzy logic control. This method automatically generates a nonlinear (deterministic) mapping from the input (e.g., $A_x$ and $(\Delta A/F)_x$) to the output (e.g., percent change of parameter X), and is advantageously implemented in the form of a lookup table. It proceeds in three steps, namely, (1) fuzzyfication of inputs, (2) application of the rule base, and (3) defuzzyfication of outputs, which will be detailed below for the case of X-adaptation; the procedure for τ-adaptation is similar. It should be pointed out that use of a fuzzy logic controller is preferred but that other controller synthesis methods may be used to produce similar results.

The following notation will be used for the linguistic values used in the rule base:

PL: positive large
NL: negative large
PM: positive medium
NM: negative medium
PS: positive small
NS: negative small
ZE: zero These values are preferably defined through the use of (possibly context dependent) membership functions.

Figure 7:
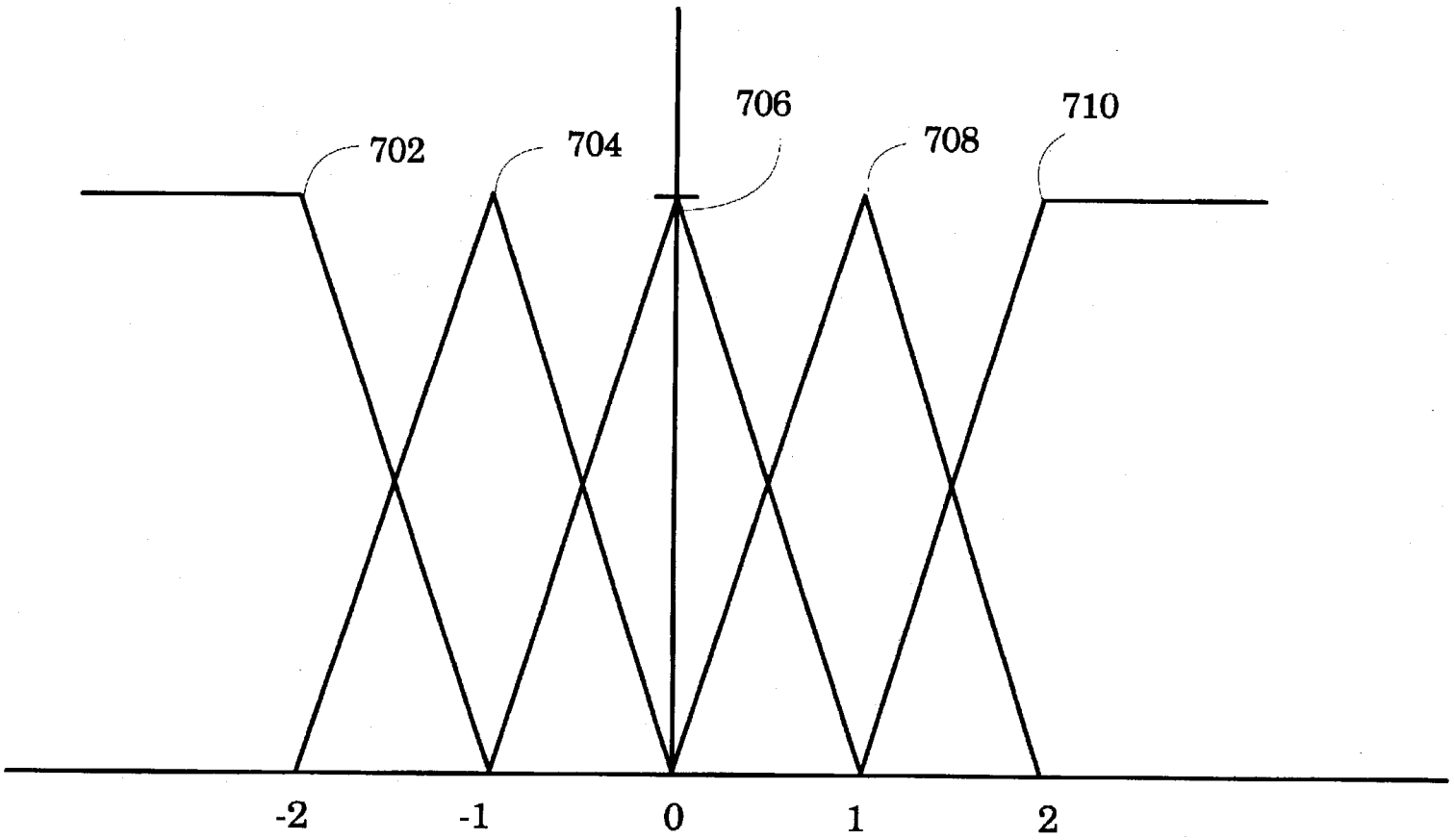

(1) Fuzzyfication. First, the numeric inputs $A_x$ and $(\Delta A/F)_x$ are "fuzzyfied", i.e., translated into linguistic or fuzzy variables A and AF respectively through the use of membership functions. As an example, consider the input $(\Delta A/F)_x$, for which one might use the membership functions illustrated in FIG. 7. In FIG. 7, point 702 represents function NL, point 704 represents NS, point 706 represents ZE, point 708 represents point PS and point 710 represents function PL. With this choice of membership functions, an input $(\Delta A/F)_x=1.5$ will be translated into:

AF is PL with degree 0.5 and PM with degree 0.5.

Note that a fuzzy variable can have several values (with different degrees) at once. Fuzzyfication of other input variables proceeds similarly, although the scaling of the domain will be different.

(2) Rule Base. The role base can conveniently be summarized in Table 1, seen below, which provides rules for fuzzy variable A, values of which are shown in the left-most column of the table, and for fuzzy variable AF, values of which are shown in the top-most row of the table:

| | NL | NS | ZE | PS | PL |
|---|---|---|---|---|---|
| NL | PM | PS | ZE | NS | NM |
| NS | PL | PM | ZE | NM | NL |
| ZE | ZE | ZE | ZE | ZE | ZE |
| PS | NL | NM | ZE | PM | PL |
| PL | NM | NS | ZE | PS | PM |

The table is read as follows:

If A is NS and AF is NL then ΔX is PL, where $\Delta X$ is the fuzzy variable associated with the change of X. It is the essence of fuzzy logic, that a predicate may evaluate to any value between 0 and 1, as opposed to "nonfuzzy" logic in which a statement is either true (1) or false (0). Therefore, the outcome of a role is usually weighted in accordance with the degree of truth of its predicate. Since A and AF may each have different linguistic values at once (with different degrees), they will generally fire more than one role. Several methods exist for combining their results (aggregation), e.g., weighted mean, maximum, etc.

(3) Defuzzyfication. After application of the role base seen in Table 1, the fuzzy variable $\Delta X$ which indicates the required change in TFC variable X, is translated back into a numeric value, again using membership functions. The membership functions for defuzzification are similar to those seen in FIG. 7 for fuzzification. In this particular example, the maximum change in X taken after any transient is 21%.

The fuzzy logic controller implicitly defines a deterministic input-output map which is implemented as a lookup table. The memory space required for implementation of the table is advantageously reduced by exploiting the inherent symmetry resulting in the input/output map. For example, both a lean A/F excursion after a tip-in condition and a rich A/F excursion after a tip-out condition indicate undercompensation of the TFC parameters. Similarly, a rich excursion after tip-in as well as a lean excursion after tip-out indicate overcompensation of TFC parameters. A preferred embodiment advantageously takes advantage of such symmetry by implementing only one half of the lookup table from which X or $\tau$ corrections are computed, given values dC and $\Delta A/F$ for derivative of air flow transient and A/F excursion respectively. This is expressed in the following equation:

$$\text{Table}(dC, \Delta A/F)=\text{Table}(-dC,-\Delta A/F). \quad (13)$$

A second type of symmetry allows a further reduction in storage size without compromising the accuracy of the adaptive TFC mechanism. For example, if a tip-in of size dC results in an A/F excursion of $\Delta A/F>0$, then the TFC parameter is multiplied, by, for example 1.15, to reflect a 15% increase. If the same tip-in resulted in an A/F excursion of the same magnitude but opposite sign, i.e., $-\Delta A/F$, then the TFC parameter is decreased by 15%, i.e., multiplied by 0.85. Hence, for given values dC and $\Delta A/F$ it is also true that $$\text{Table}(dC, \Delta A/F)=2-\text{Table}(+dC,-\Delta A/F). \quad (14)$$

Figure 5:
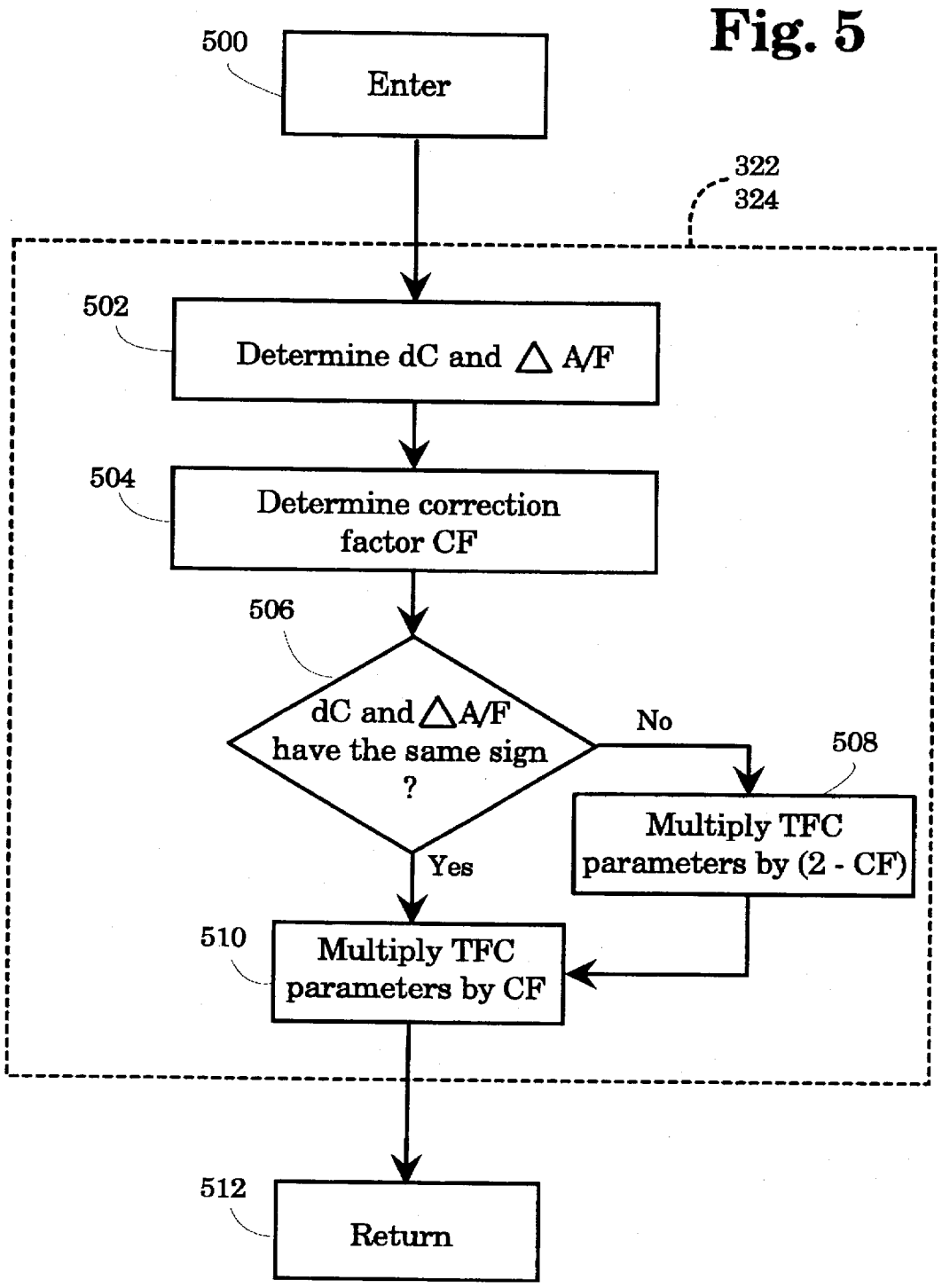

In summary, taking advantage of the symmetry as described above allows only one quarter of the lookup table to be stored in memory, for example, the quarter of the table where $dC\geqq 0$ and $\Delta A/F\geqq 0$. FIG. 5 of the drawings shows the steps taken at steps 322 and 324 in greater detail to implement the above described adaptation of TFC parameters X and $\tau$. At step 502, the values dC and $\Delta A/F$ are read as determined by 318 or 320, and at step 504 a correction factor (CF) is determined from the aforementioned reduced table with inputs abs(dC) and abs($\Delta A/F$). At step 506, the sign (negative or positive) of the values dC and $\Delta A/F$ are compared, and if the signs are different then at step 508, the TFC parameters X or $\tau$ are adapted by a corrected value of CF. As seen at 508 the value CF is corrected as explained above by (2–CF). Otherwise, if dC and $\Delta A/F$ have the same sign, then at 510 the appropriate TFC parameter is adapted by multiplying it with the correction factor CF.

Preferably, appropriate parameters are read from memory, depending on engine operating conditions, and updated parameters are returned to the same memory location. Alternatively, one has an initially calibrated table of base values for $\tau$ and X, and stores the corrective terms in separate tables.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. An electronic engine controller comprising:

means, responsive to a switching type oxygen sensor which generates a first indication if exhaust gas produced by said engine is rich of stoichiometry and a second indication if exhaust gas produced by said engine is lean of stoichiometry, for generating an enhanced air/fuel value indicative of the air/fuel ratio combusted by said engine; and means, responsive to said air/fuel value, for generating a fuel injection value, indicative of an amount of fuel injected by a fuel injector into an induction system of the engine comprising, means responsive to a transient engine operating condition for determining the magnitude of said transient condition;

means, responsive to said magnitude, for characterizing said transient in terms of one of a plurality of predefined transient characterization groups, to adapt an equilibrium fuel time constant, representative of a rate of change of the fuel mass on the walls of the induction system during the transient engine operating condition, and to adapt a fuel transfer rate value which is indicative of the portion of fuel injected from said injector which remains on the walls of said induction system; and means, responsive to said equilibrium fuel time constant and to said fuel transfer rate value, for generating said fuel injection value.

2. The invention as set forth in claim 1 wherein the means for generating an enhanced air/fuel value indicative of the air/fuel ratio combusted by said engine comprises:

means for modulating said air/fuel value by a periodically varying modulation signal;

means, responsive to said oxygen sensor, for generating a jumping window average of the composition of said exhaust gas; and means for generating said enhanced air/fuel value as a function of said jumping window average.

3. The invention as set forth in claim 1 further comprising means for detecting said transient engine operating condition, which comprises:

means for retrieving said air/fuel value and for generating a cylinder aircharge value as a function of said air/fuel value;

means for delaying said cylinder aircharge value for an mount of time substantially equal to a transport delay of said exhaust gas from an exhaust port of said engine to said oxygen sensor;

means, responsive to said delayed cylinder aircharge value for determining the time rate of change of said delayed cylinder aircharge value; and means for comparing said time rate of change to an adaptable reference value to detect said transient engine operating condition.

4. The invention as set forth in claim 1 wherein the means for characterizing said transient in terms of one of a plurality of predefined transient characterization groups comprises:

means for fuzzifying said cylinder aircharge value and said air/fuel value;

means for applying said fuzzified cylinder aircharge value and said air/fuel value to a rule base to generate fuzzy outputs; and means for defuzzifying said outputs to generate said equilibrium time constant and said fuel transfer rate value.

5. An electronic engine controller for controlling the delivery of fuel to an intake port of an internal combustion engine, said engine including a switching type oxygen sensor which generates an oxygen signal to provide a first indication if exhaust gas produced by said engine is rich of stoichiometry and a second indication if exhaust gas produced by said engine is lean of stoichiometry, the electronic engine controller comprising:

means for enhancing information contained in said oxygen signal to generate an enhanced exhaust gas composition value;

means responsive to an air meter signal for determining the aircharge entering an intake manifold of said engine;

means, responsive to said air charge, for generation of a transient start condition in response to onset of a transient engine operating condition and for generation of a transient end condition in response to completion of a transient operating condition;

means responsive to said transient start condition means for quantifying said condition as a function of a first transient fuel control parameter; and means, responsive to said quantification of said first transient fuel control parameter, for adaptively modifying said first transient fuel control parameter;

means responsive to said transient end condition comprising, means for quantifying said condition as a function of a second transient fuel control parameter; and means, responsive to said quantification of said second transient fuel control parameter, for adaptively modifying said second transient fuel control parameter.

6. The electronic engine controller as set forth in claim 5 wherein said first transient fuel control parameter is indicative of an equilibrium fuel time constant representative of a rate of change of the fuel mass on the walls of said intake manifold during said transient operating condition and wherein said second transient fuel control parameter is indicative of a fuel transfer rate value which is indicative of the portion of fuel injected into said intake manifold which remains in said intake manifold.

7. The electronic engine controller as set forth in claim 6 wherein said means for adaptively modifying said first transient fuel control parameter and wherein said means for adaptively modifying said second transient fuel control parameter each employ a fuzzy logic controller.

8. The electronic engine controller as set forth in claim 7 wherein said means for enhancing information contained in said oxygen signal comprises:

means for modulating an air/fuel feedback signal which is responsive to said oxygen signal;

means responsive to said oxygen signal, for generating a jumping window average of the exhaust content indicated by said oxygen signal; and means for generating said enhanced gas composition value as a function of said jumping window average.

9. The electronic engine controller as set forth in claim 8 wherein said means for generating said transient start condition and said transient end condition comprises:

means for determining the time rate of change of said aircharge;

means for comparing said time rate of change and a prior time rate of change to an adaptable reference value;

means for generating said transient start condition if said time rate of change is greater than said reference value and if said, prior time rate of change is less than or equal to said reference value; and means for generating said transient end condition if said time rate of change is less than or equal to said reference value and if said prior time rate of change is greater than said reference value.

10. An electronic engine controller for controlling the delivery of fuel to an intake port of an internal combustion engine, said engine including a switching type oxygen sensor which generates an oxygen signal to provide a first indication if exhaust gas produced by said engine is rich of stoichiometry and a second indication if exhaust gas produced by said engine is lean of stoichiometry, the electronic engine controller comprising:

means for enhancing information contained in said oxygen signal to generate an enhanced exhaust gas composition value;

means responsive to an air meter signal for determining the aircharge entering an intake manifold of said engine;

means, responsive to said air charge, for generation of a transient start condition in response to onset of a transient of a transient engine operating condition and for generation of a transient end condition in response to completion of a transient operating condition;

means responsive to said transient start condition means for quantifying said condition as a function of a first transient fuel control parameter; and means, responsive to said quantification of said first transient fuel control parameter, for adaptively modifying said first transient fuel control parameter;

means responsive to said transient end condition comprising, means for quantifying said condition as a function of a second transient fuel control parameter;

means, responsive to said quantification of said second transient fuel control parameter, for adaptively modifying said second transient fuel control parameter;

said means for adaptively modifying said first transient fuel control parameter and said means for adaptively modifying said second transient fuel control parameter each comprising, means, responsive to an aircharge change value indicative of the time rate of change of said air charge and to an air/fuel change value indicative of a change in said enhanced exhaust gas composition value for retrieving a correction factor, said aircharge change value and said air/fuel change value being characterized by a sign which indicates a value above or below zero;

means responsive to the sign of said aircharge change value and said air/fuel change value being different for adaptively modifying said transient fuel control parameter in a first manner; and means responsive to the sign of said aircharge change value and said air/fuel change value being the same, for adaptively modifying said transient fuel control parameter in a second manner.

11. The electronic engine controller as set forth in claim 10 wherein said means for enhancing information contained in said oxygen signal comprises:

means for modulating an air/fuel feedback signal which is responsive to said oxygen signal;

means responsive to said oxygen signal, for generating a jumping window average of the exhaust content indicated by said oxygen signal; and means for generating said enhanced gas composition value as a function of said jumping window average.

12. The electronic engine controller as set forth in claim 11 wherein said first transient fuel control parameter is indicative of an equilibrium fuel time constant representative of a rate of change of the fuel mass on the walls of said intake manifold during said transient operating condition and wherein said second transient fuel control parameter is indicative of a fuel transfer rate value which is indicative of the portion of fuel injected into said intake manifold which remains in said intake manifold.

* * * * *